US007661243B2

(12) United States Patent
Lindberg

(10) Patent No.: US 7,661,243 B2
(45) Date of Patent: Feb. 16, 2010

(54) APPARATUS FOR TRANSPORTING ROLLS DURING PACKING

(75) Inventor: Harri Lindberg, Järvenpää (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 12/083,469

(22) PCT Filed: Oct. 13, 2006

(86) PCT No.: PCT/FI2006/050442

§ 371 (c)(1),
(2), (4) Date: Apr. 11, 2008

(87) PCT Pub. No.: WO2007/042625

PCT Pub. Date: Apr. 19, 2007

(65) Prior Publication Data

US 2009/0053022 A1 Feb. 26, 2009

(30) Foreign Application Priority Data

Oct. 14, 2005 (FI) ..... 20051040

(51) Int. Cl.
*B65B 25/14* (2006.01)
*B65B 11/56* (2006.01)

(52) U.S. Cl. ..... 53/167; 53/210; 53/389.2; 414/222.13; 414/911

(58) Field of Classification Search ..... 53/167, 53/168, 210, 211, 389.2; 414/222.13, 911; *B65B 11/56, B65B 11/58, 25/14*

See application file for complete search history.

(56) References Cited

U.S. PATENT DOCUMENTS 3,342,014 A 9/1967 Prager (Continued)

FOREIGN PATENT DOCUMENTS

CA 2003605 6/1990

(Continued)

OTHER PUBLICATIONS

Finnish Office Action and Search dated Apr. 24, 2006 issued in a corresponding application.

*Primary Examiner*—Stephen F Gerrity
(74) *Attorney, Agent, or Firm*—Cohen Pontani Lieberman & Pavane LLP

(57) ABSTRACT

A method for moving paper, board and cellulosic web rolls in a roll packaging system comprising a plurality of roll handling stations. The system imports at least three rolls (10, 16, 17) via a receiving station (5), the rolls (10, 16, 17) are moved in the system by the use of a car (4) of an indexing conveyor, the car being adapted to move synchronously at each roll handling station, the car (4) is moved in a return motion when the indexing conveyor car (4) is in its lowermost position (elevation level −1), the rolls (10, 16, 17) are moved in synchronism forward to at least one station, e.g., the wrapping station (7) and to at least one other station (6 or 8 or 9), and at least one roll (10) is moved at one station (7) in the direction of the roll's longitudinal axis. All rolls (10, 16, 17) in the system are moved at least once synchronously having the indexing conveyor car (4) driven into its uppermost position (second elevation level 2), and at least one roll (10) is moved at one station (7) having the indexing conveyor car (4) driven into a vertical position (elevation level 1) situated at any level between the uppermost and the lowermost elevation level.

5 Claims, 16 Drawing Sheets

U.S. PATENT DOCUMENTS

| | | | | |
|---|---|---|---|---|
| 4,485,612 | A | | 12/1984 | Piesen et al. |
| 5,046,298 | A | * | 9/1991 | Norkoski et al. ..... 53/399 |
| 5,265,399 | A | | 11/1993 | Niskanen et al. |
| 5,501,058 | A | | 3/1996 | Sonoyama et al. |
| 5,642,600 | A | | 7/1997 | Hooper et al. |
| 5,727,359 | A | | 3/1998 | Rampp |
| 5,983,606 | A | | 11/1999 | Hannen et al. |
| 6,039,284 | A | | 3/2000 | Lehrieder et al. |
| 6,264,417 | B1 | | 7/2001 | Salsburg |
| 2008/0273949 | A1 | | 11/2008 | Lindberg |
| 2009/0053022 | A1 | | 2/2009 | Lindberg |

FOREIGN PATENT DOCUMENTS

| | | | | |
|---|---|---|---|---|
| EP | 0 499 954 | | | 8/1992 |
| FI | 57561 | | | 5/1980 |
| FI | 89149 | | | 9/1996 |
| FI | 116719 | | | 2/2006 |
| FI | 116720 | | | 2/2006 |
| GB | 2 044 713 | | | 10/1980 |
| JP | 05278716 | A | * | 10/1993 |
| JP | 07040925 | A | * | 2/1995 |
| WO | WO 2005/100158 | | | 10/2005 |

* cited by examiner

APPARATUS FOR TRANSPORTING ROLLS DURING PACKING

CROSS REFERENCE TO RELATED APPLICATIONS

This is a U.S. national stage of application No. PCT/F12006/050442, filed on 13 Oct. 2006. Priority is claimed on Finland Application No. 20051040, filed 14 Oct. 2005, the entire contents of which are incorporated here by reference.

BACKGROUND OF THE INVENTION

1. Field of the Invention

The present invention relates to a method for transferring rolls of paper, board and cellulosic web in a roll packaging system during wrapper winding, label attachment and header placement.

The invention also relates to an assembly for implementing the method.

2. Description of the Prior Art

The papermaking industry generally uses a packaging method wherein inner headers are first placed on the ends of a roll to be packaged, whereupon a wrapper is wound about the roll and finally the outer headers are placed on the roll ends. The packaging cycle and system themselves can be implemented in different ways and, typically, the packaging system is tailored to the needs of the mill. Inasmuch as the roll widths vary in a wide range, the wrapping method of the roll wrapper must be selected to meet the wrapping capacity needs. If an extremely high packaging capacity is required, wrapping stations can be used equipped with plural wrapper rolls of different widths of which a suitable wrapper can be selected for any roll to be packaged. However, this kind of wrapping station is very costly, whereby within the capacity limits of the station it may be more cost-advantageous to use, e.g., wrapping by overlapping layers, whereby two or more parallel wrapper courses are wound about the perimeter of the web roll. This kind of wrapping technique can be implemented using one or two wrapper widths thus allowing a very simple station layout. A disadvantage herein, however, is that either the roll being wrapped or the wrapping station itself must be moved during wrapping so as to allow the parallel wrapper courses to be wound.

In the above-mentioned overlap wrapping, the paper, board or cellulosic web rolls to be packaged are wrapped using a wrapper narrower than the roll to be wrapped. As the wrapper width is not sufficient to cover the entire perimeter width of the web roll, the roll is packaged by winding plural parallel wrapper turns thereabout. For such parallel overlap wrapping on a web roll, either the roll or the wrapper car or both must be moved parallel to the longitudinal axis of the roll. One technique of implementing the roll transfer is to move the roll being packaged on the cars of an intermittent-motion indexing conveyor. The indexing conveyor has separate stations for each packaging step: roll entry, buffer, wrapping, labeling and placement of outer headers, whereby one indexing conveyor car is located at each one of the stations. The car or cars are reciprocatingly moved between the stations so that after a car has moved a roll to the next station, the car is returned to its "home" position to be ready to receive a new roll to be transferred. To move the rolls forward, the indexing conveyor of the car(s) is moved upward, whereby the rolls thereon are elevated from the support rollers or support means of the station. As the car of the conveyor system has a fixed construction or, alternatively, the indexing car conveyor is comprised of cars connected together and moving in synchronism, all rolls are moved simultaneously. A roll transferred in this kind of system to the wrapping station is positioned by the movements of the indexing conveyor. Such a positioning of the web rolls at the wrapping station is unproblematic provided that the wrapper rolls with their feed assemblies are adapted movable at the wrapping station. However, if the wrapping station structures are stationary, lateral transfer of the roll at the wrapping station causes substantial time loss in overlap wrapping. Namely, the roll must be moved laterally in the direction of its longitudinal axis for winding the adjacent wrapper courses. Herein, an indexing conveyor is obviously problematic, because it forces all of the web rolls to move at the transfer of web roll being wrapped. Hence, after the completion of overlap wrapping of a roll, all the other rolls must be relocated back to their center positions at their respective stations by the movements of the indexing conveyor, which is a retarding step in the cycle time. While this may not necessarily drawback if only a small number of rolls are to be overlap wrapped, the roll sizes vary widely in modern papermaking mills, whereby the transfer movements of the indexing conveyor may give rise to a substantial reduction of available packaging capacity.

SUMMARY OF THE INVENTION

It is an object of the present invention to provide a method offering an improvement to the operating speed of a packaging system using an indexing conveyor.

The goal of the invention is attained by arranging the loading surface of at least one car at a given station, e.g., the car positioned at the wrapping station, to rise to a level above the loading surface elevations of the other cars and, further, adapting the indexing conveyor to operate using at least four different elevations, or vertical positions of the conveyor.

The invention provides significant benefits.

By virtue of the invention, the operating speed of a packaging system in the overlap wrapping of rolls can be increased with extremely simple arrangements. A separate center positioning of rolls after the completion of the overlap wrapping step of a roll becomes redundant, whereby the overlap-wrapping-related lengthening of cycle time remains as minimal as the cumulative wrapping time due to the winding of the two or three adjacent wrappers. Inasmuch as the positions of rolls at other stations than the wrapping station remains stationary, the positioning of the other rolls remains accurately at the set coordinates. The mechanical constructions needed in the implementation of the invention are uncomplicated and require only actuators controllable to at least four different elevation levels. With the help of the lowermost elevation level, the transfer of the indexing conveyor car back to the receiving station can be accomplished even when a roll already resides on the station. The lowermost elevation level is set such that at all stations the rolls are situated higher than the top surface of the indexing conveyor car at each respective station when the conveyor car has been driven to the lowermost elevation level. In addition to this lowermost elevation level, the conveyor may have three, four or even a greater number of elevation levels. In conventional packaging systems, however, it appears that generally maximally four elevation levels are needed. The transfer of rolls to the receiving station is more secure when a deeper space is provided between the support rollers.

BRIEF DESCRIPTION OF THE DRAWINGS

In the following, the invention is examined in more detail with the help of the appended drawings in which.

DETAILED DESCRIPTION OF THIE PREFERRED EMBODIMENTS

Figure 1:
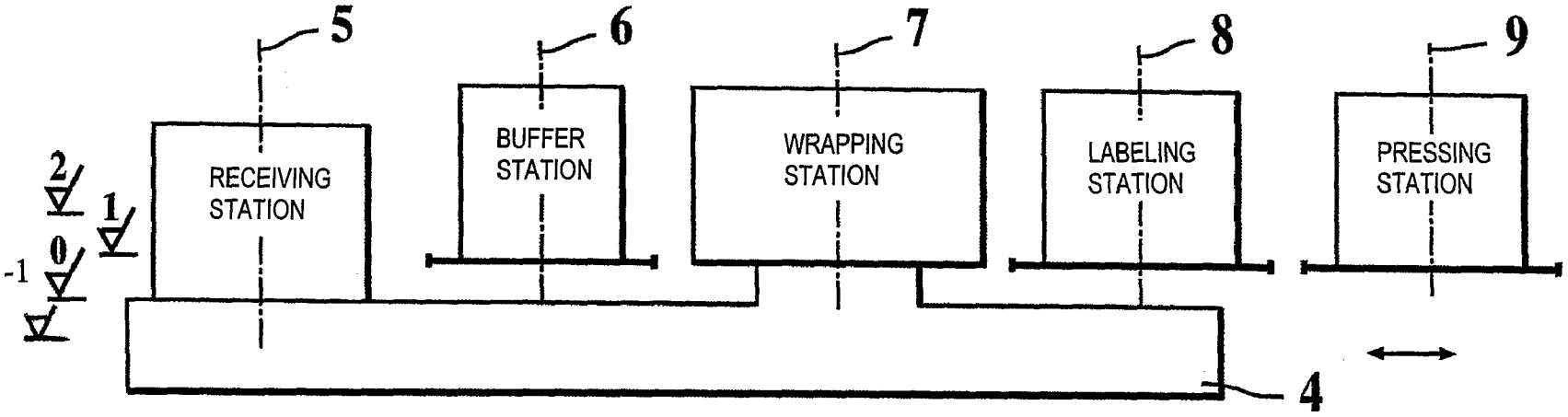
FIG. 1 shows a side elevation view of a construction according to the invention.

Referring to FIG. 1, therein is illustrated the multiple elevation principle of the invention. A car 4 of an indexing conveyor is adapted adjustable at four different heights later in the text called elevation levels. Along the length of one car 4 of the indexing conveyor are situated five packaging system stations: receiving station 5, buffer station 6, wrapping station 7, labeling station 8 and header placement/roll ejection station 9. The lowermost elevation level −1 is a level at which the indexing conveyor car 4 can be moved under all stations even when each one of them might have a roll resting thereon. This function is very essential at the receiving station. In order to permit the receiving station to admit a roll thereon into a waiting position when the indexing conveyor has been transferred away from under the station, it is necessary to have the conveyor during its return motion to travel at an elevation level lower that the bottom side of the roll placed on the receiving station 5 inasmuch as the conveyor car would otherwise hit during its return motion the roll already placed on the station. The next lowest elevation level 0 is the so-called base level at which rolls placed on the receiving station 5 can be moved while the other rolls remain stationary. At the first elevation level 1, the roll located at the wrapping station may be moved with all the other rolls staying stationary and, at the second elevation level 2, all the rolls are elevated to the indexing conveyor car 4, whereby they move synchronously. If a roll happens to be at the receiving station, it will move along with the transfer of the roll residing at the first elevation level.

At the receiving station 5, a roll to be placed on the conveyor is positioned differently depending on whether the roll shall be wrapped into a single wrapper or whether it needs overlap wrapping, whereby plural adjacent wrapper courses must be wound thereon. For this position operation, the receiving station 5 is provided with a parallelogram mechanism suited to elevate and lower the roll in regard to the indexing conveyor car 4. Respectively, the wrapping station 7 must have equivalent means for moving one roll without simultaneously causing uncontrolled movement of other rolls. To this end, the top level of the car 4 is elevated at the wrapping station to a higher position in regard to the car top level elevation at the other stations. Additionally, each station is provided with support rollers or support means on which the rolls can be lowered in situations requiring the indexing conveyor car 4 to be moved, e.g., during the return movement of car 4, without disturbing the positions of the other rolls. The positioning of the rolls at the stations can be performed in either a centered or offset fashion. In the present text, centered positioning refers to a roll position having its center point in the lateral dimension of the roll being aligned with the centerline of the station, while offset positioning refers to any roll position having the roll center point shifted into an offset position from the centered position.

Figure 3:
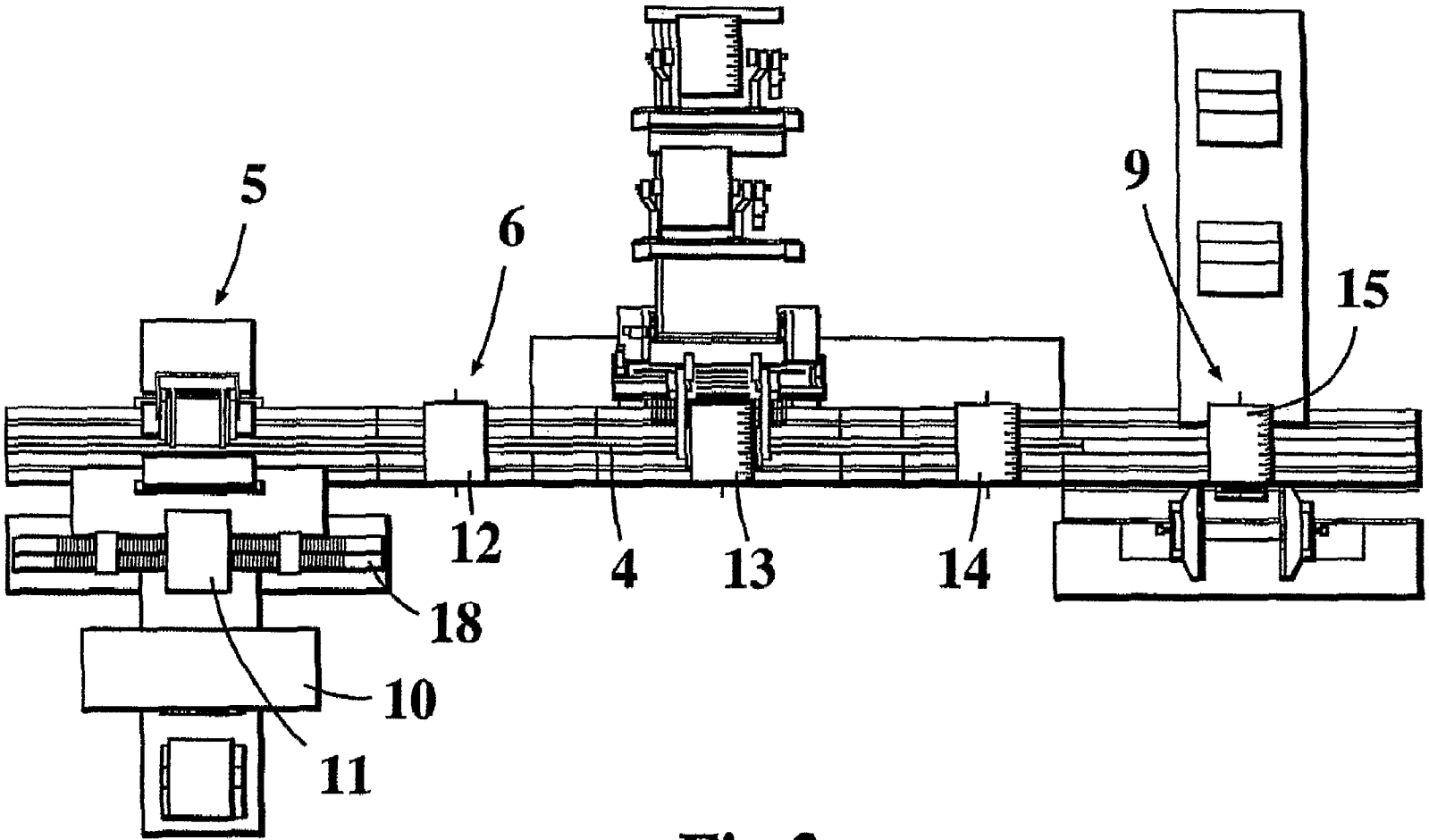
FIG. 3 schematically shows a top view of an assembly according to the invention in its first operating stage.
Figure 4:
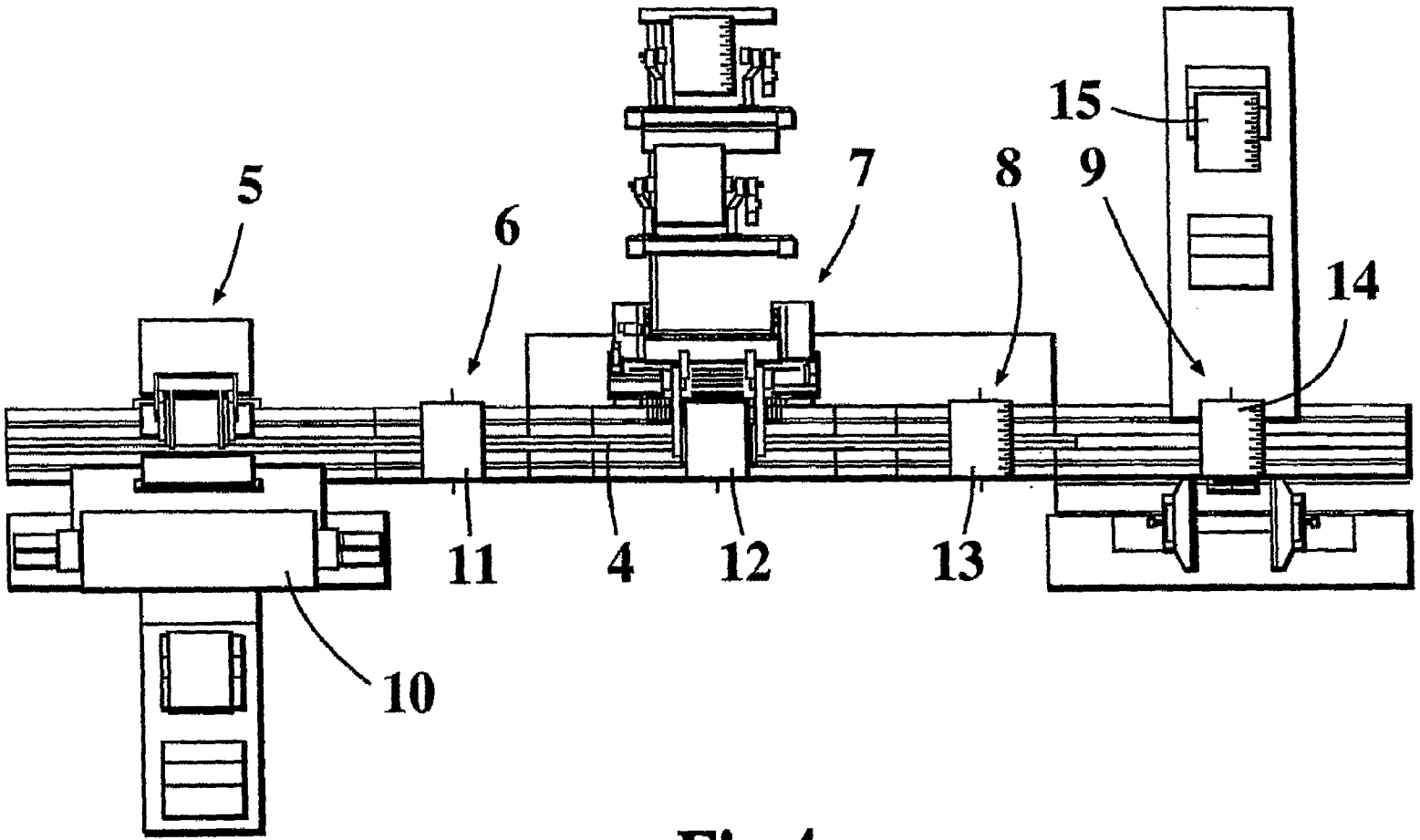
FIG. 4 schematically shows a top view of the assembly according to the invention in its second operating stage.
Figure 5:
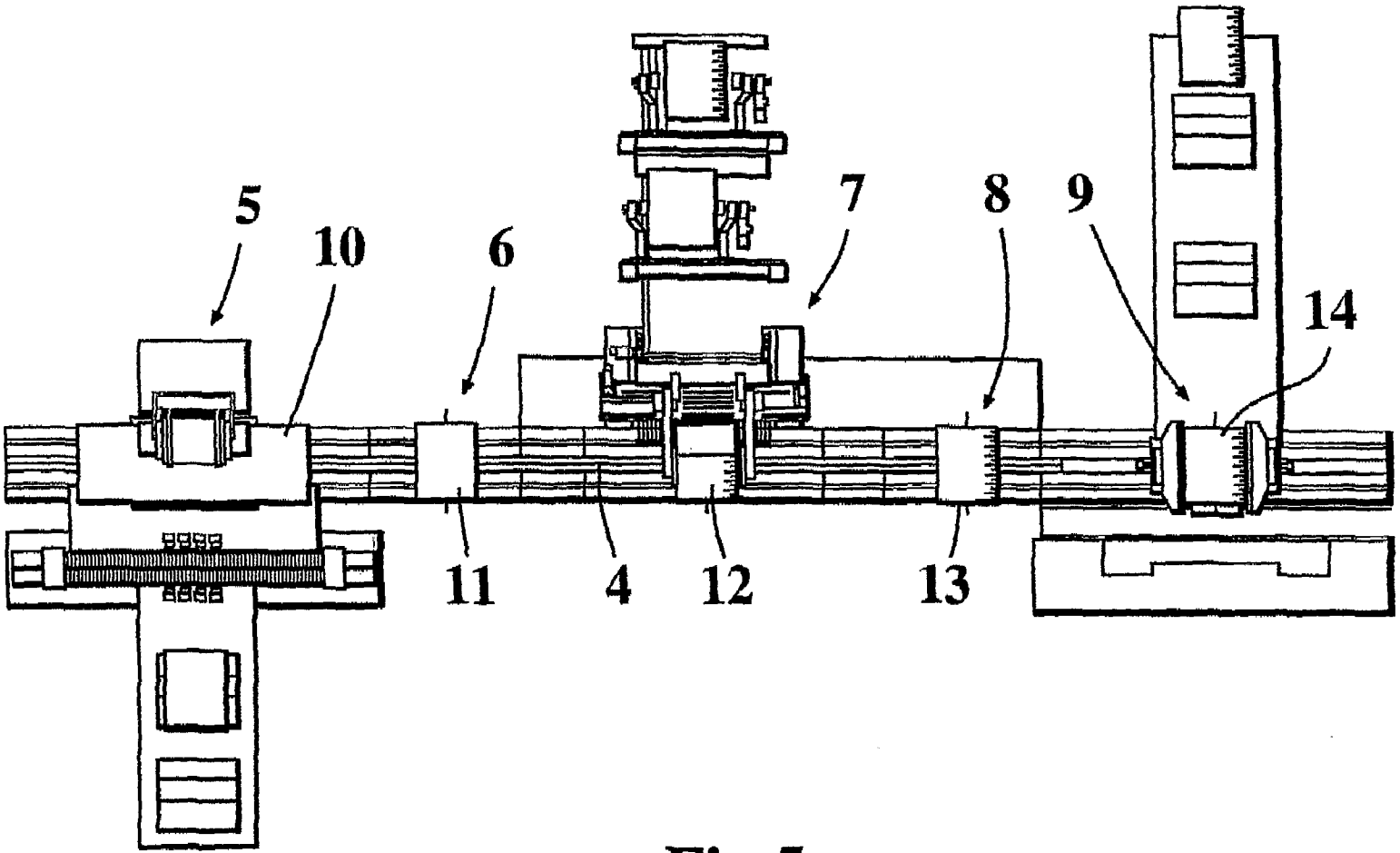
FIG. 5 schematically shows a top view of the assembly according to the invention in its third operating stage.
Figure 6:
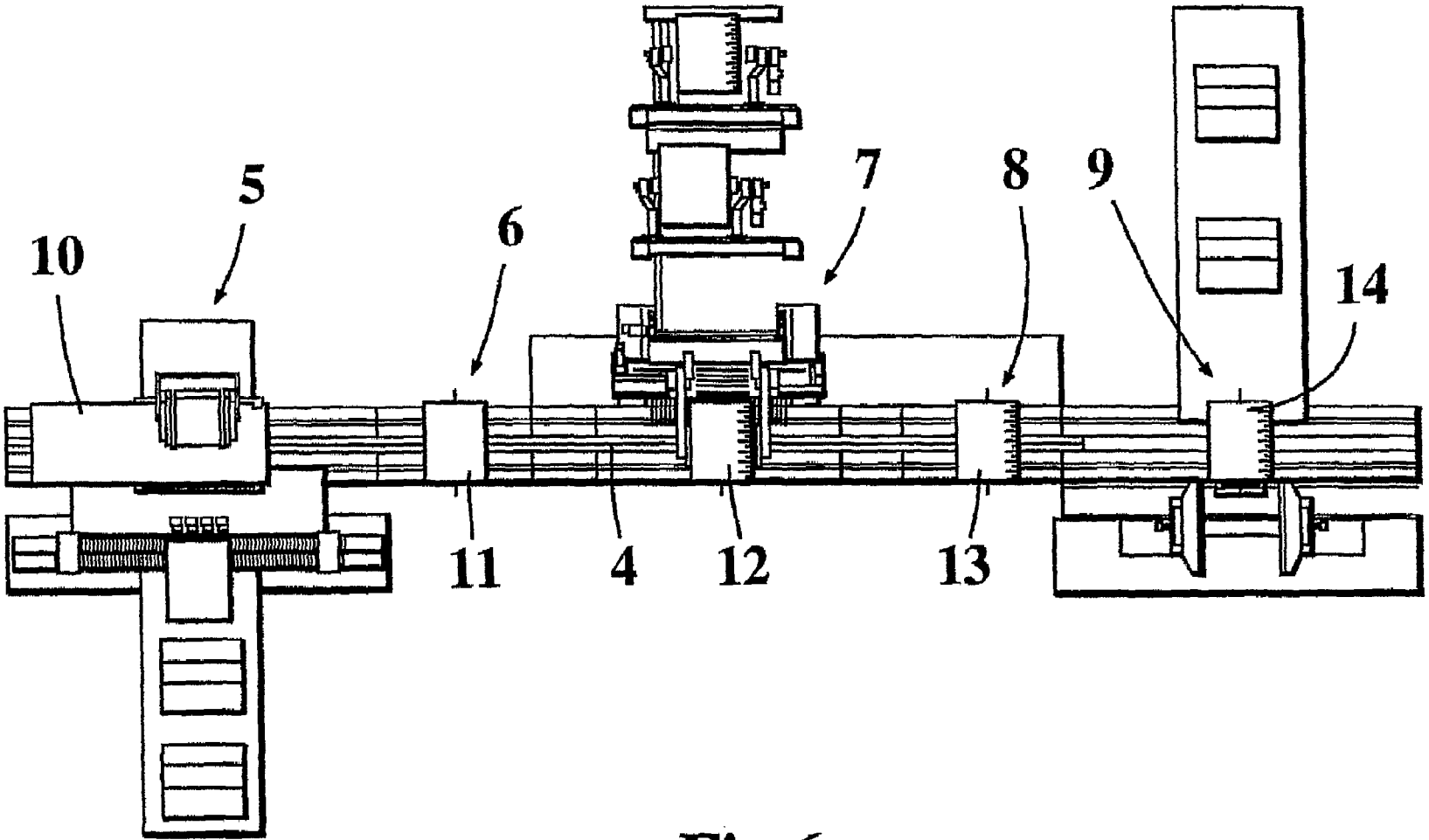
FIG. 6 schematically shows a top view of the assembly according to the invention in its fourth operating stage.
Figure 7:
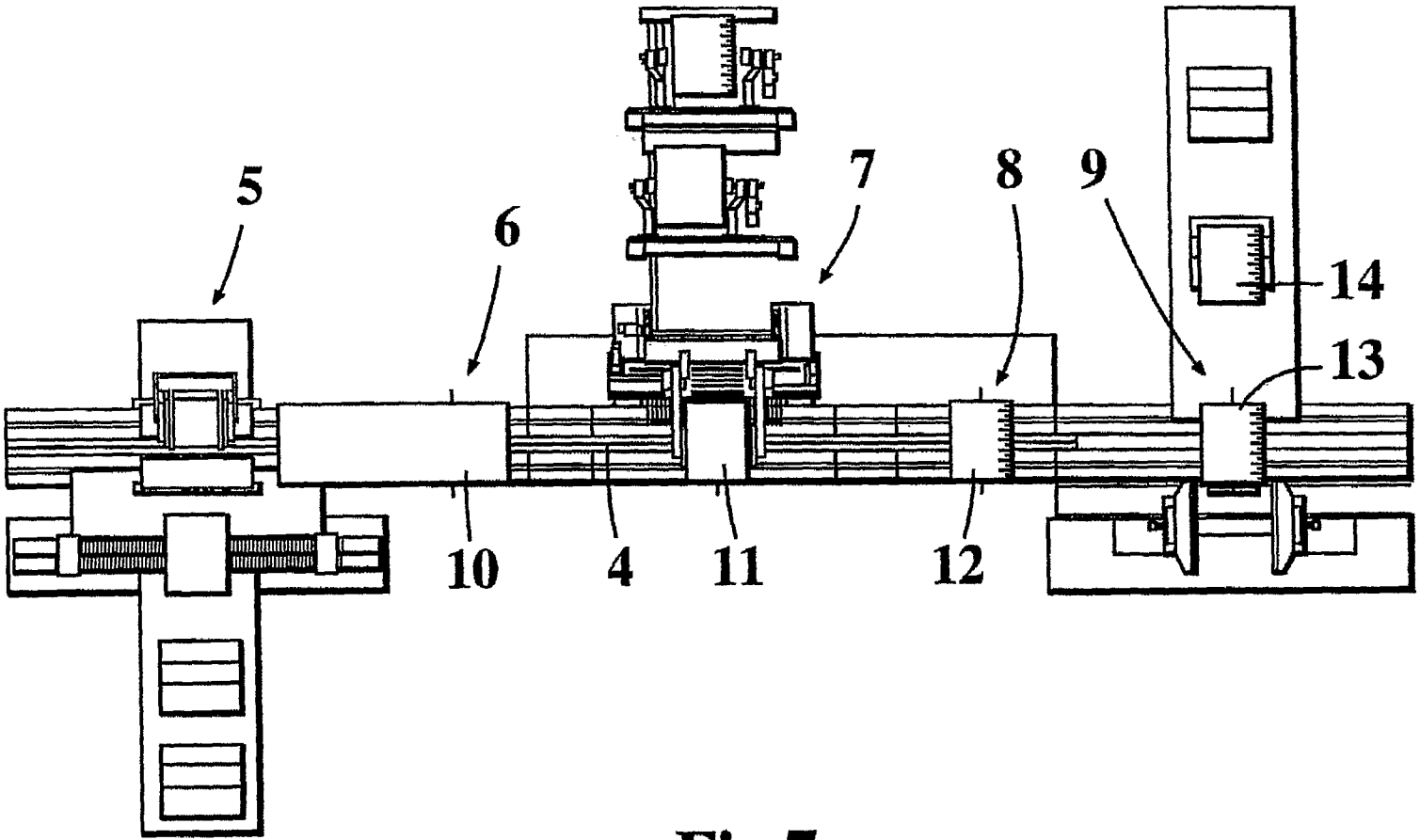
FIG. 7 schematically shows a top view of the assembly according to the invention in its fifth operating stage.
Figure 8:
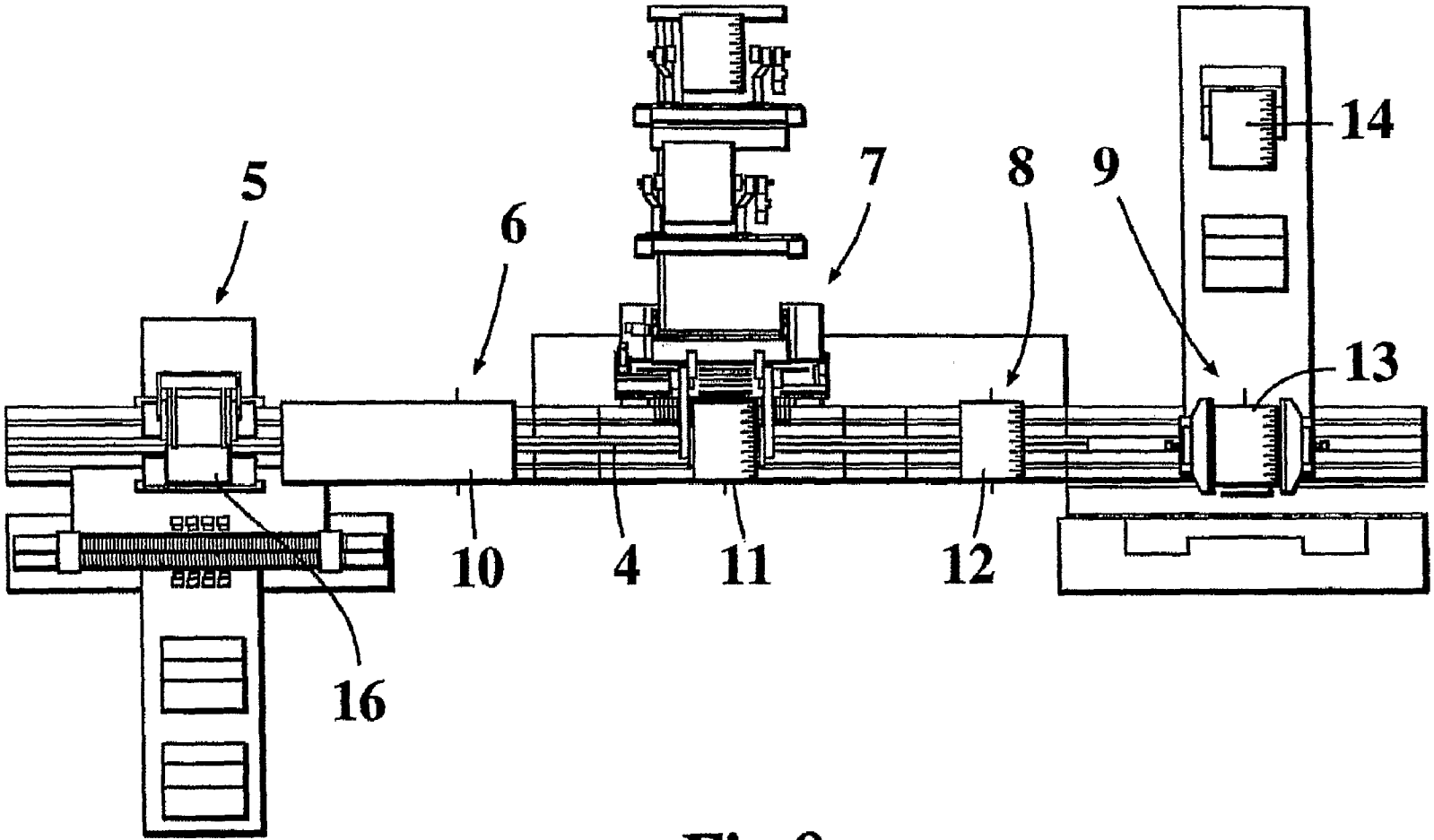
FIG. 8 schematically shows a top view of the assembly according to the invention in its sixth operating stage.

Next, the invention is discussed in greater detail with the help of FIGS. 3-18. This sequence of diagrams illustrates the travel of a wide roll in the packaging system as the roll is being wrapped using three-wide overlap wrapping. In FIG. 3, a roll 10 to be taken to overlap wrapping is shown entering the receiving station 5 of the centering station 18. Preceding the roll to be overlap wrapped, other rolls to be single-wrapper packaged are entering the receiving station, namely: roll 10, roll 12 at the buffer station 6 situated downstream from the receiving station 5, roll 13 at the wrapping station 7, roll 14 at the labeling station 8 and roll 15 at the pressing station 9 waiting for the placement of the roll headers. During the following step, a roll 11 is taken to the buffer station 5, wherein the roll position is centered. Next, the indexing conveyor car 4 is elevated by two level shifts, whereby rolls at all stations are raised upward thus allowing the rolls to be moved forward. After the movement of car 4 in the indexing conveyor has been completed, the situation is as shown in FIG. 4, where the receiving station 5 is empty and the other stations have rolls 11-14 to be packaged in a single wrapper waiting in a centered position. The receiving station 5 is shown ready for the entry of roll 10 to be overlap wrapped. The roll 10 to be overlap wrapped is still at the centering station, where it is positioned in regard to its longitudinal direction so that the roll can be lowered into the proper position on the indexing conveyor car. This centering step is necessary to guarantee correct positioning of the roll at the packaging stations. When a roll to be overlap wrapped enters the receiving station, the supporting means of the roll are driven to their lower positions and the roll to be overlap wrapped is lowered directly onto the indexing conveyor car 4. This situation is shown in FIG. 5. As the indexing conveyor car 4 is at elevation level −1, that is, in its lowest position, the roll situated at the receiving station 5 can be moved. The roll 10 to be overlap wrapped is next moved by the indexing conveyor into a position, wherein the roll enters correctly located for wrapping: the roll is moved backward so that the roll entering the wrapping station 7 has its end properly positioned in regard to the wrapper edge for winding the first wrapper course. This situation is shown in FIG. 6.

Figure 9:
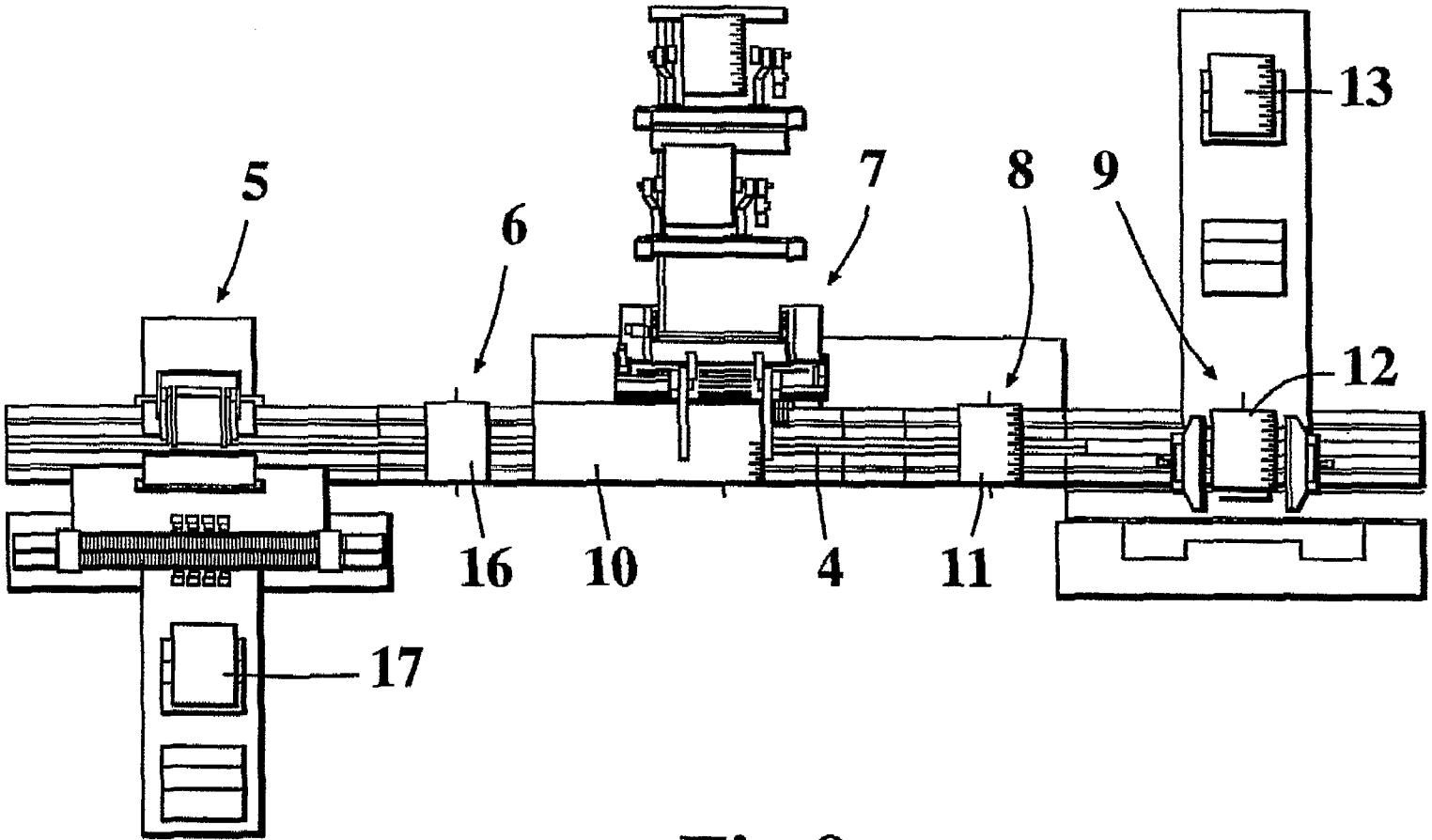
FIG. 9 schematically shows a top view of the assembly according to the invention in its seventh operating stage.
Figure 10:
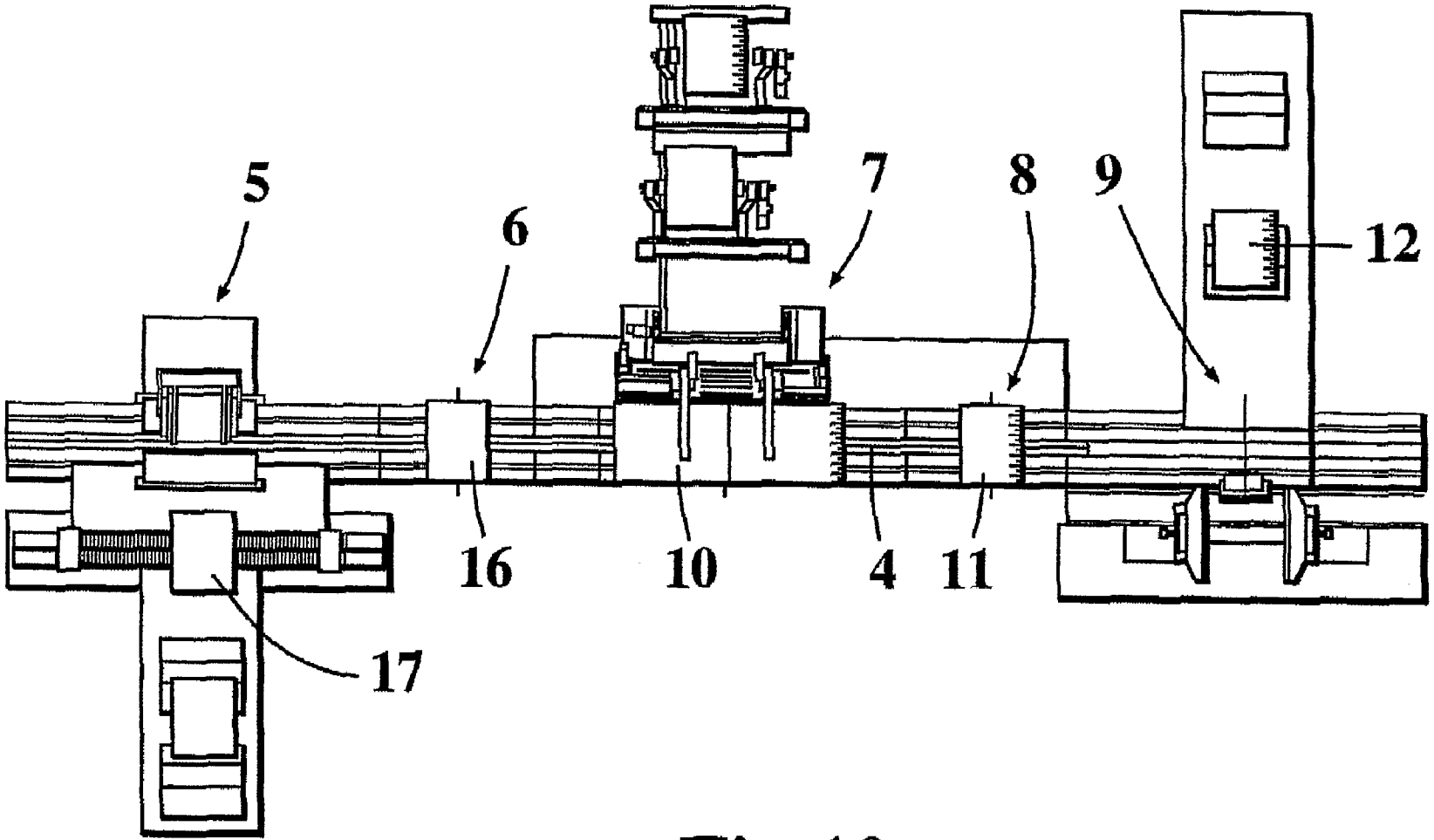
FIG. 10 schematically shows a top view of the assembly according to the invention in its eighth operating stage.
Figure 11:
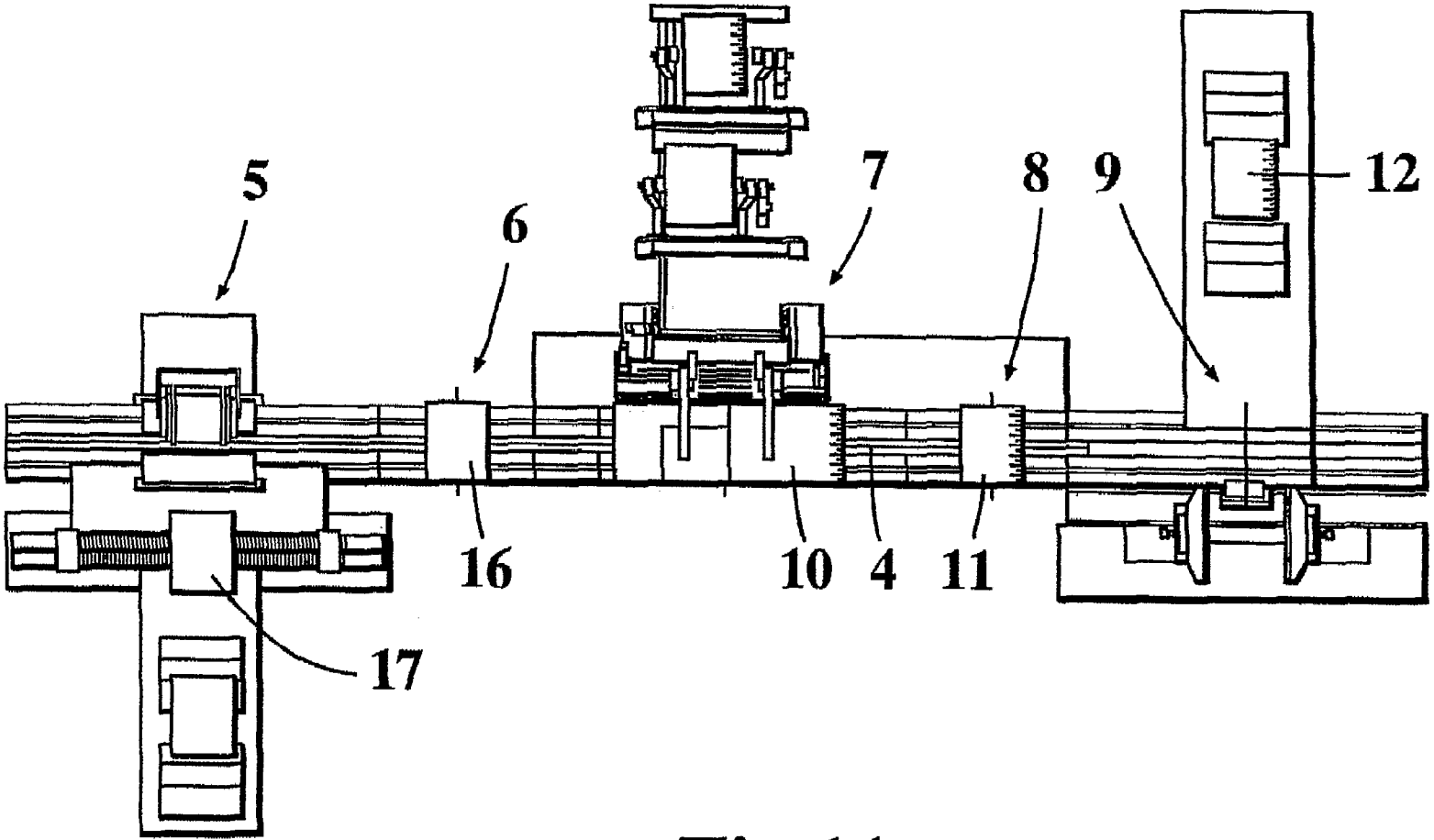
FIG. 11 schematically shows a top view of the assembly according to the invention in its ninth operating stage.
Figure 12:
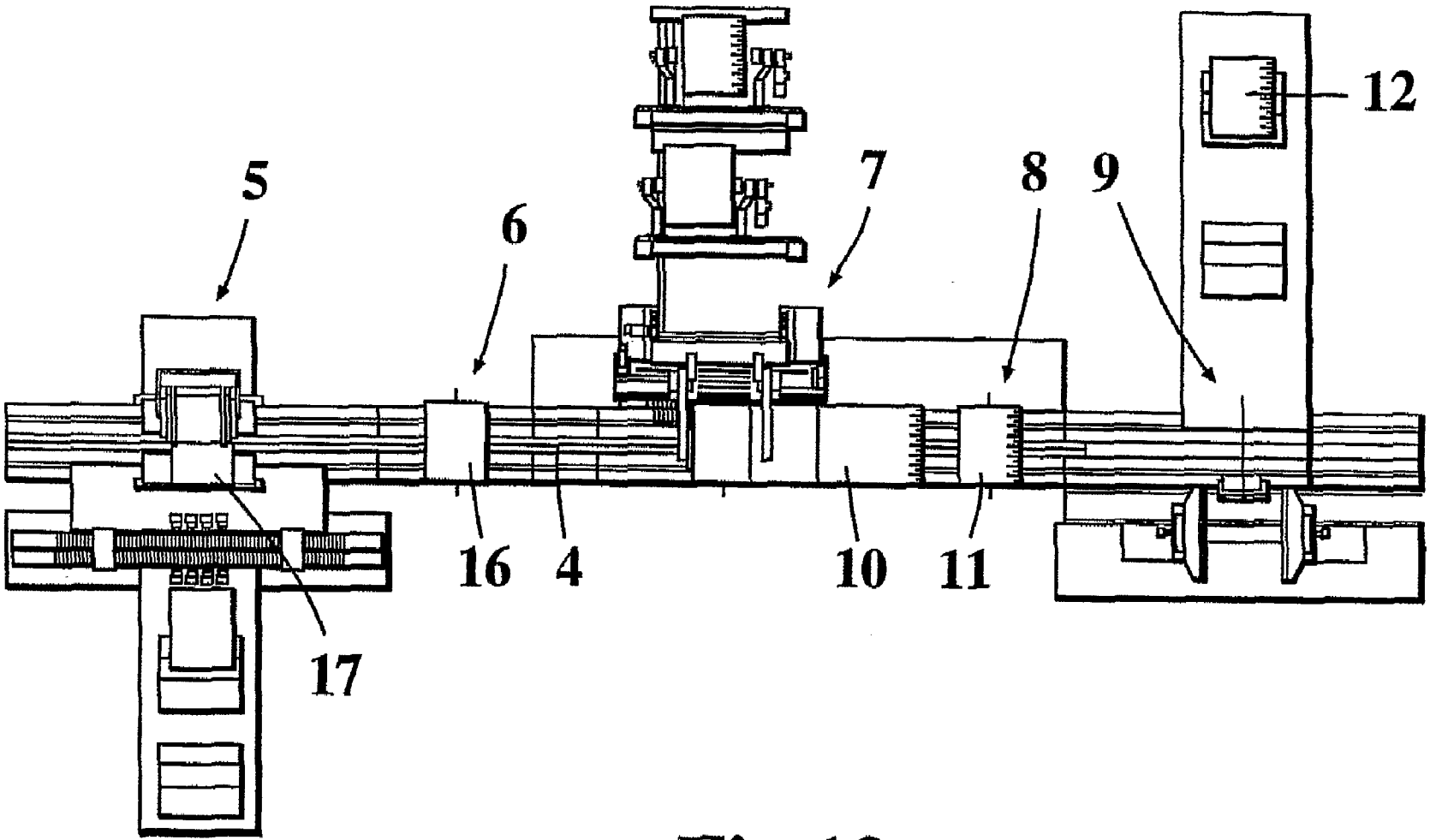
FIG. 12 schematically a top view of the assembly according to the invention in its tenth operating stage.
Figure 13:
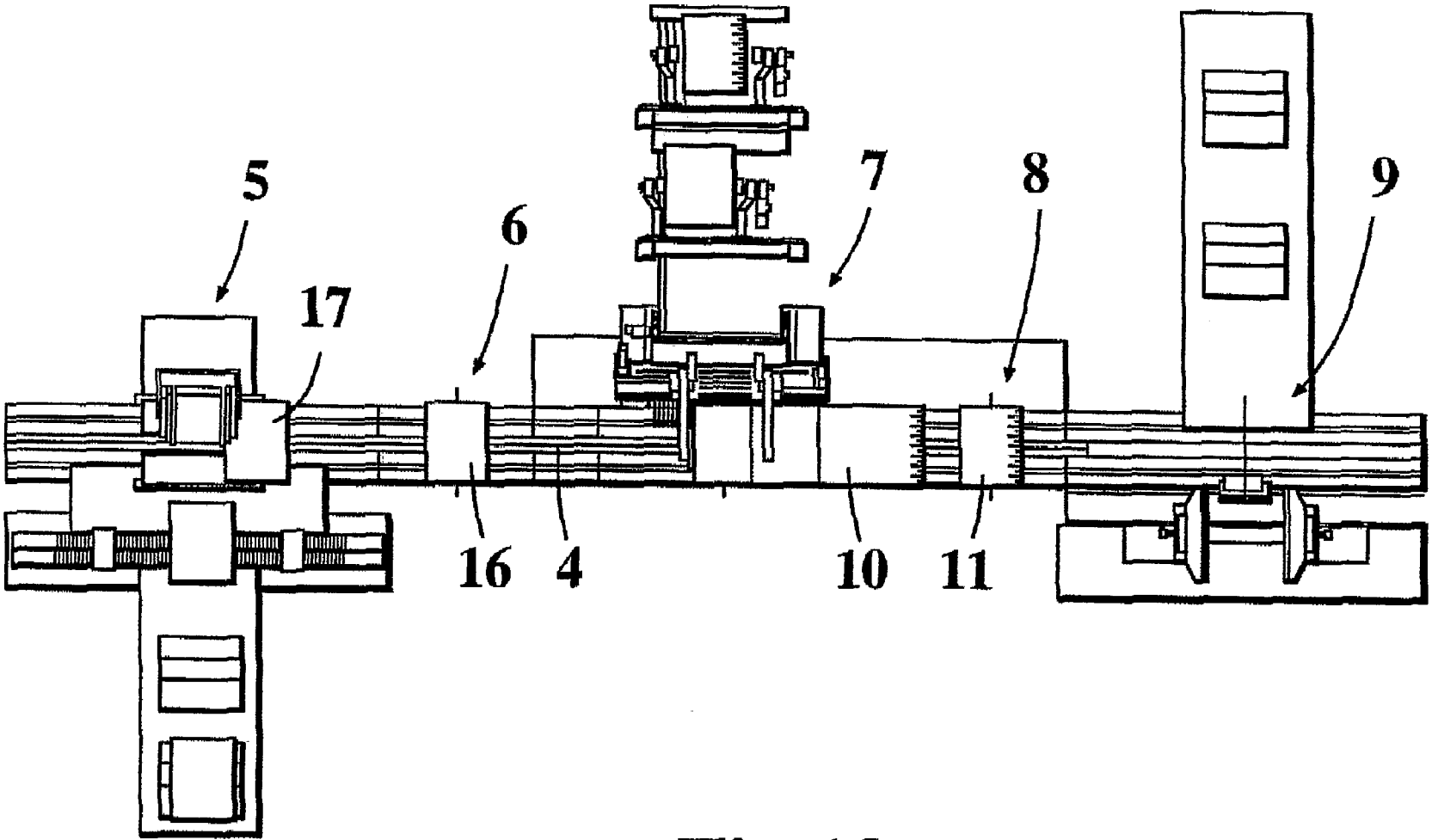
FIG. 13 schematically a top view of the assembly according to the invention in its eleventh operating stage.
Figure 14:
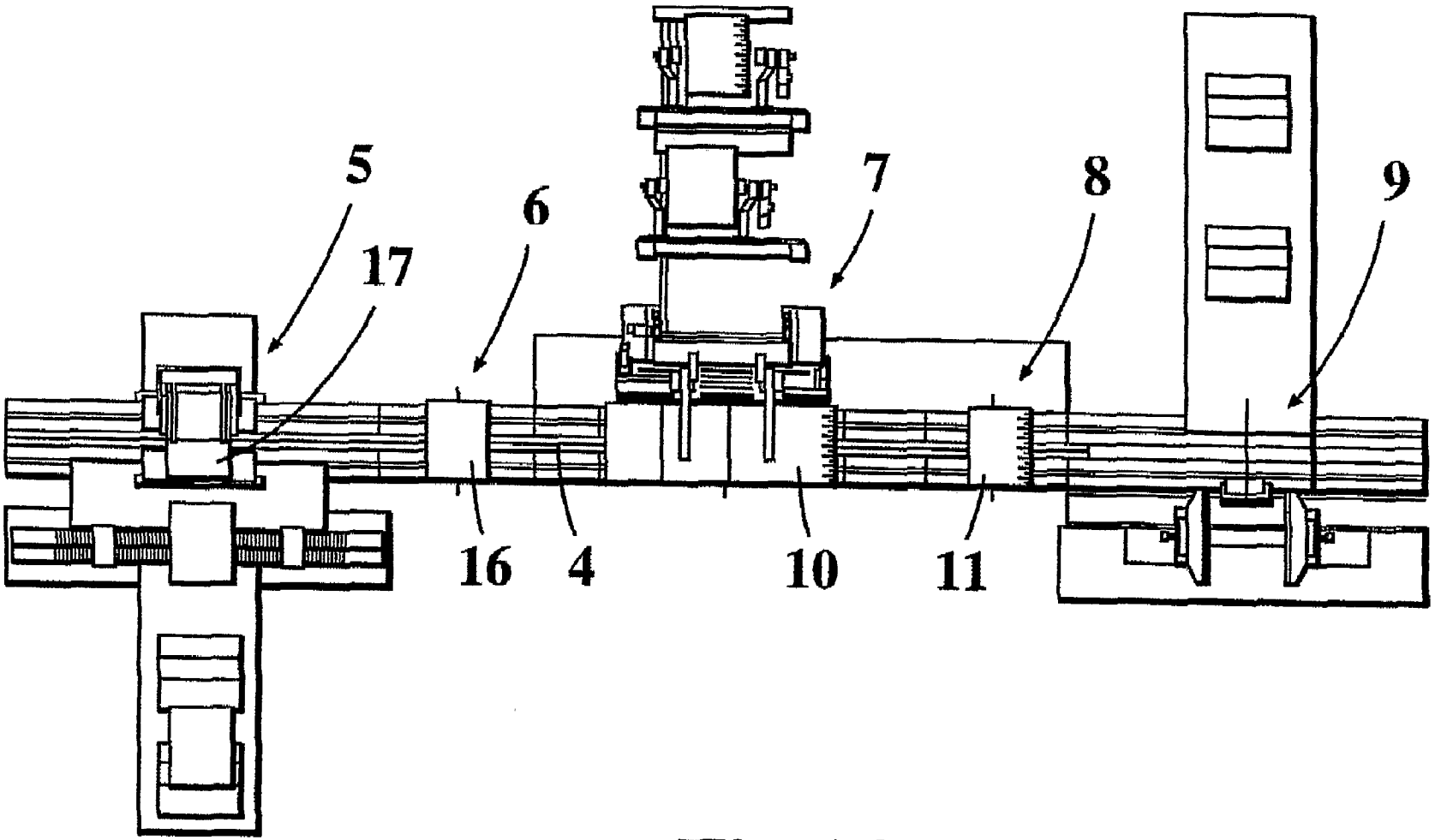
FIG. 14 schematically a top view of the assembly according to the invention in its twelfth operating stage.
Figure 15:
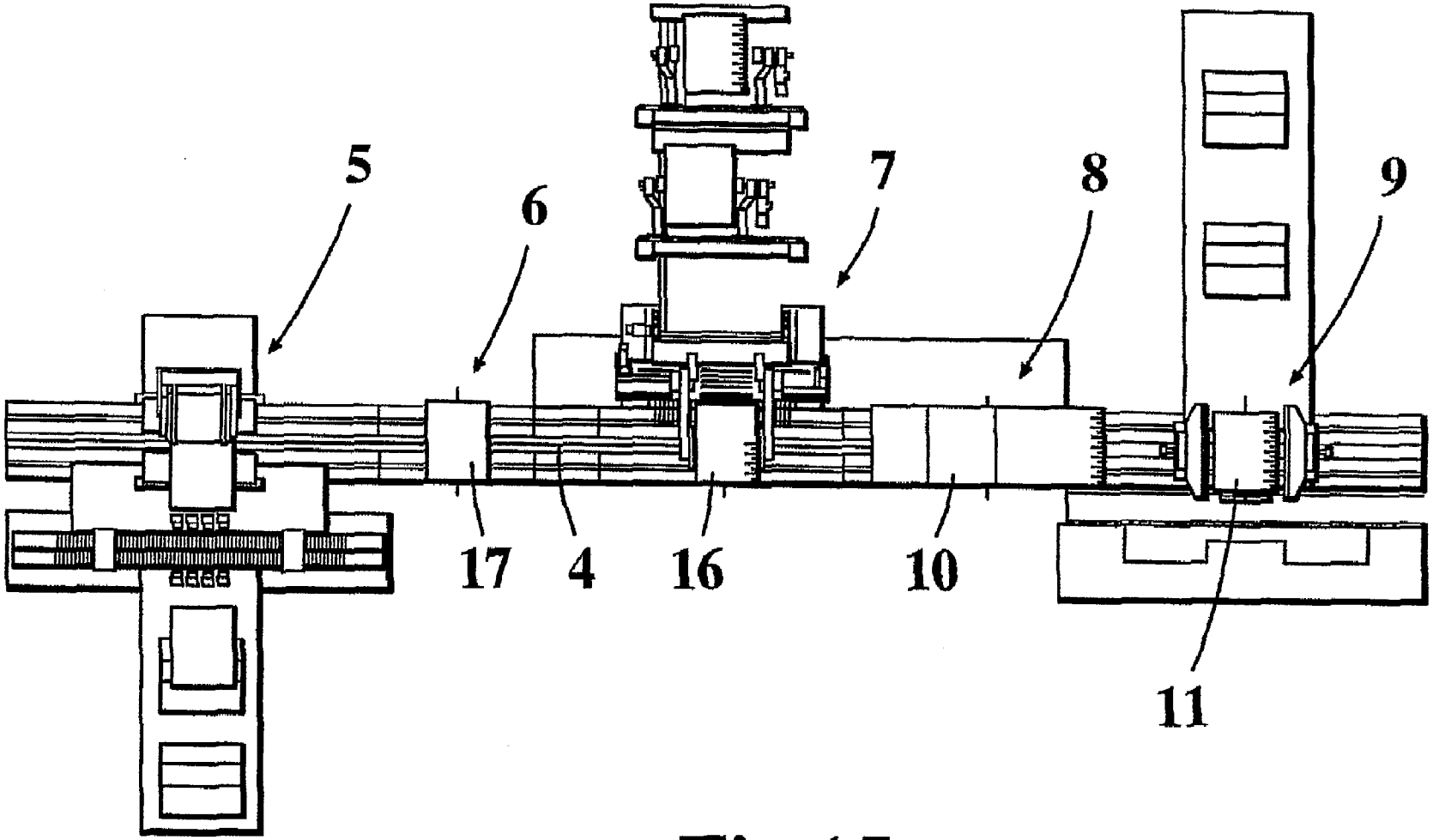
FIG. 15 schematically shows a top view of the assembly according to the invention in its thirteenth operating stage.

Next, the indexing conveyor car is raised by two steps to the second elevation level 2, whereby all rolls 10-13 located at stations 5-8 are elevated upward with the exception of roll 14 situated at the pressing station 9 for attachment of roll headers. At this moment, the roll 14 residing at the pressing station must be ejected or the pressing station must already be empty. Next, the indexing conveyor car is transferred forward, whereby all the rolls resting on the indexing conveyor are transferred forward. After the transfer step, rolls 10-13 are lowered onto their support means and the indexing conveyor car is moved backward. At this moment, the roll 10 to be overlap wrapped is situated in an offset position at the buffer station 6 and the other rolls 11-13 are in centered positions at their respective stations. This sequence leaves the conveyor in the situation of FIG. 7. Thereafter, to the receiving station 5 is loaded the next roll 16 that is positioned centrally, whereby the situation of FIG. 8 results. After elevating the indexing conveyor car by two stages to the second elevation level 2 and transferring the car 4 one step forward, the situation of FIG. 9 is attained, wherein the roll 10 to be overlap wrapped is correctly positioned at the wrapping station 7 for winding the first wrapper course thereon. Subsequent to winding the first wrapper, the indexing conveyor car 4 is elevated by one step to the first elevation level 1, whereby roll 10 residing at the wrapping station 7 rises upward and, if the indexing conveyor car has another roll loaded thereon at the receiving station, also the latter roll is moved up, however, without any change in its positioning. Next, the roll 10 to be overlap wrapped is moved forward for winding the second wrapper course and the situation of FIG. 10 is attained. Subsequent to the second wrapping, the roll 10 is once more transferred on the first elevation level of the car to the station performing the third wrapping as shown in FIG. 11. Simultaneously, a new roll 17 is taken to the buffer station. This situation is shown in FIG. 12. Next, roll 17 taken to the receiving station is transferred at the base elevation level forward into an offset position (see FIG. 13) such that when roll 10 residing at the wrapping station 7 is transferred into a centered position moving the roll at the first elevation level 1 backward, also roll 17 residing at the receiving station 5 is moved backward into a centered position. Having the support means of the receiving station 5 driven into their lower position, also rolls 17, 10 residing at the receiving and wrapping stations are elevated upward while the other rolls remain resting on their support means. This situation is shown in FIG. 14. Hereupon, the indexed forward transfer of the rolls can be continued at elevation level 2, whereby all the rolls move in synchronism, i.e., to the position shown in FIG. 15. When a new roll is to be admitted into the system, the roll may be prefetched to the receiving station 5 even while the other rolls are still being handled and, when the positioning/centering of the new roll can be started or the is to be moved from the station to the system, the indexing conveyor car is transferred at the lowermost elevation level −1 to under the roll prefetched to the receiving station. Thereupon, the roll is picked onto the conveyor by raising the conveyor car to the base elevation level 0. With the help of the elevation level −1 and the base level, a roll resting on the receiving station may be moved if so desired without any need for rising/lowering support rollers. Resultingly, one actuator can be eliminated from the system. When the receiving station is empty, the conveyor car may obviously driven thereto even at the base elevation level 0.

Figure 16:
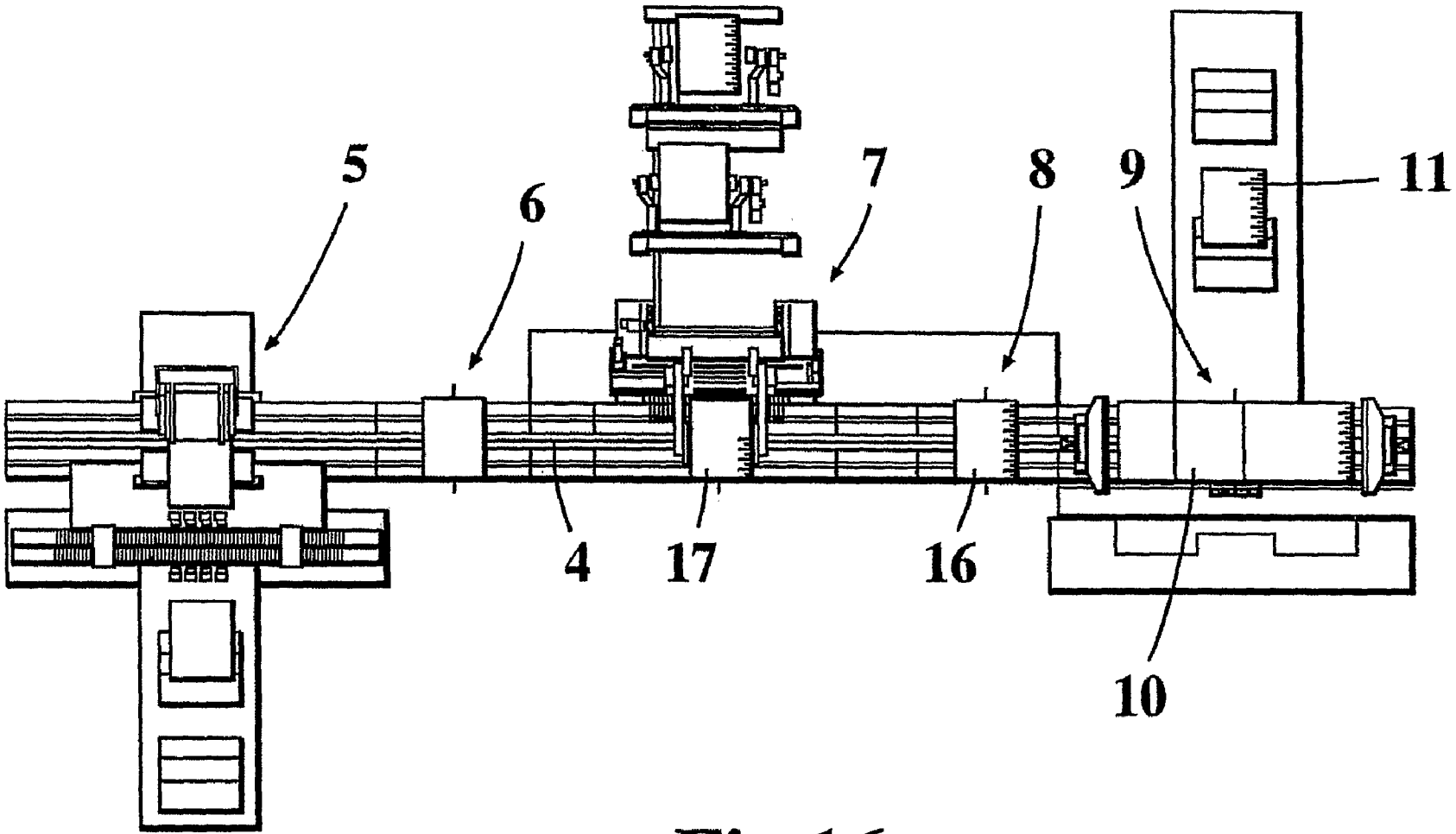
FIG. 16 schematically shows a top view of the assembly according to the invention in its fourteenth operating stage.
Figure 17:
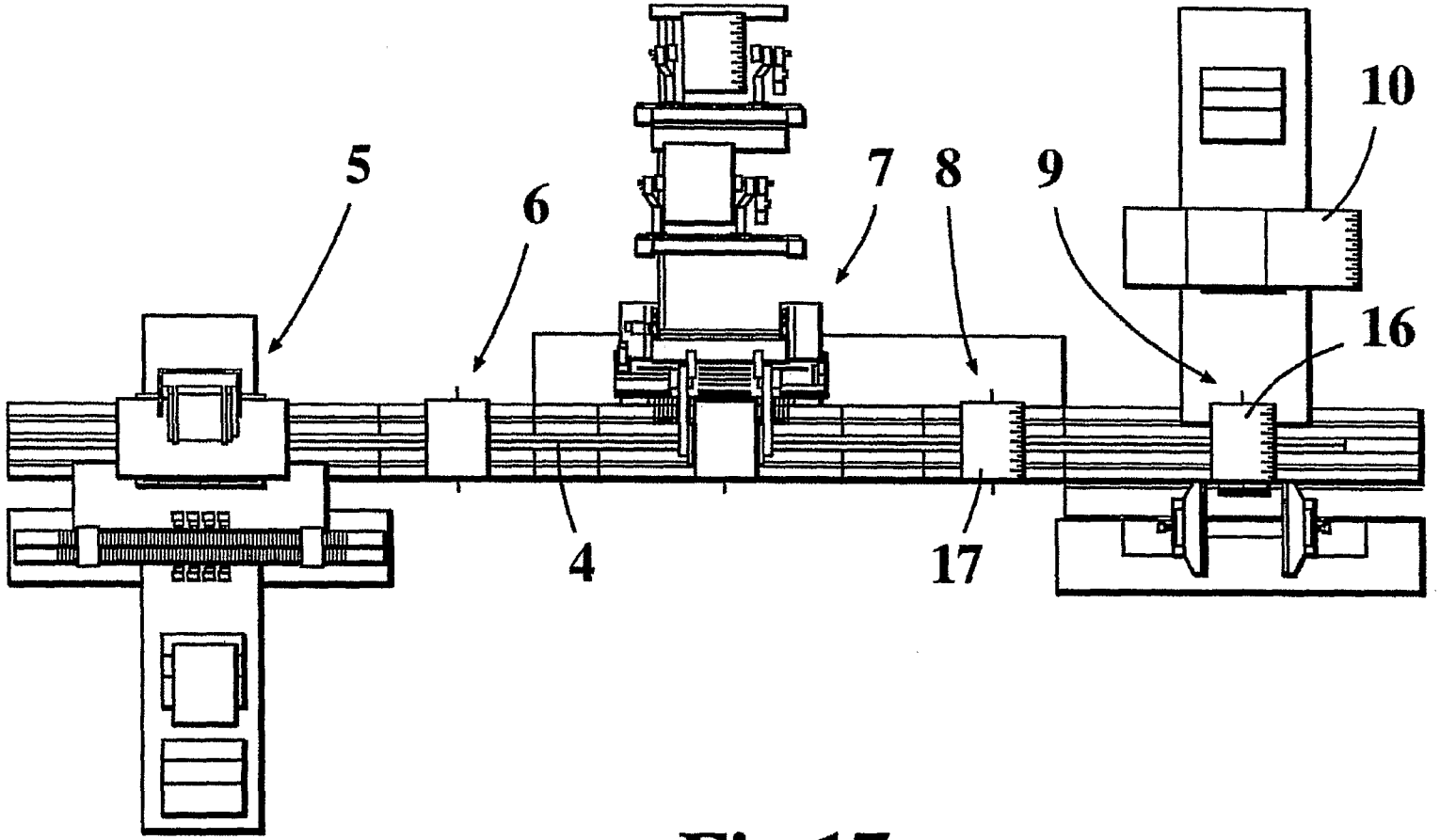
FIG. 17 schematically shows a top view of the assembly according to the invention in its fifteenth operating stage.

FIG. 16 shows the situation when roll 10 is moved to the header placement/roll ejection station 9. FIG. 17 shows the situation when roll 10 is moved off of the car 4 and into the header placement/roll ejection station 9.

The above-described cycle is reinitiated when a roll to be overlap wrapped enters the receiving station 5.

Figure 2:
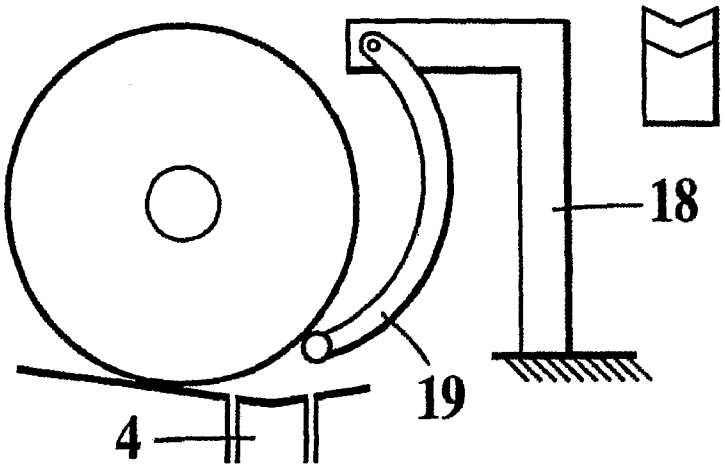
FIG. 2 shows an embodiment of a receiving station.

The receiving station can be equipped with a loading/elevating apparatus based on a parallelogram mechanism such as is disclosed in Canadian patent no. 2,003,605. If the capacity need is not excessively high requiring the maximally fast operating speed, the arrangement shown in FIG. 2 may be used. Herein, the roll is manipulated by means of a top-side receiver comprising a frame 18 and a receiver arm 19. The arm 19 serves to retard the motion of the roll and stop the roll on the indexing conveyor car. When the indexing conveyor car 4 must be moved without disturbing the positioning of the roll, the receiver arm can be actuated to unload the roll from the car and reload it back onto the car after the movement thereof is at a standstill. Thus, this arrangement provides the same function as a loading/unloading apparatus. The position of the arm may be monitored by means of an absolute position sensor, whereby a roll entering a station can be positioned accurately beside the indexing conveyor. Then, lowering the roll onto the car needs only a minimal transfer movement resulting in a short cycle time increment. Roll diameter and position sensor signals must be available for roll positioning. Based on this information, the roll position at the side of the can be computed. Obviously, a bottom-side receiver can be used in lieu of the topside receiver.

In the above text, a system has been described comprising five separate roll handling stations. Obviously, the number of roll handling stations can be varied according to the number of roll packaging and handling stages required in the system. However, the minimum system layout capable of implementing the method according to the invention comprises at least a receiving station, some other station and a wrapping station. The number of stations following the wrapping station is unessential to the implementation of the invention inasmuch as the rolls leave the wrapping station in a centered position. If the number of stations is only two, the arrangement according to the invention is unnecessary. While the offsetting transfer of rolls required at the stations may be carried out at any station preceding the wrapping station, in practice this step is most advantageously carried out at the receiving station. The car of the wrapping station can be a single, contiguous car or, alternatively, it may comprise a number of connected and thus jointly moving separate cars. A roll to be overlap wrapped may be offset positioned already at the centering station 18 preceding the receiving station. Then, no offset movement is needed at the buffer station, but instead, the roll can be loaded at the base level 0 directly onto the car and no movement of the car is required for offset positioning of the roll. However, offset prepositioning of the roll can be carried out at any station when the conveyor is operating at its base level 0. Alternatively, the roll may be taken to the wrapping station ready centered, whereby the roll end is positioned at the wrapping station for the first wrapping stage before starting wrapping. The operating strategy is selected so that the system gives sufficient and optimal packaging capacity in a particular operating environment. The elevated portion of the car may also be situated elsewhere than at the wrapping station if a need arises at some other station to move the rolls in their longitudinal direction. In certain cases, narrow rolls must be transferred during labeling if multiple labels must be attached at their center line. In the case that transfer operations between the stations are substantially different from each other, it may be necessary to use a greater number of four in the elevation levels, e.g., five or six. However, the lowermost elevation must always be such that allows the indexing conveyor car to move freely at each one of the stations whether rolls are loaded thereon or not. The next elevation level to the lowermost one is such that allows the transfer of a roll resting on at least one station without the need for moving at least one other roll. The need for other elevation levels is dictated by the local roll transfer criteria.

What is claimed is:

1. An assembly for moving paper, board and cellulosic web rolls in a roll packaging system, comprising:

a plurality of roll handling stations including at least one receiving station for receiving rolls into the system, one wrapping station for winding at least one wrapper course on the periphery of the rolls, and at least one other station; and an indexing conveyor that includes a car for moving the rolls, the indexing conveyor car being adapted to move synchronously into positions coinciding with each one of said roll handling stations, the indexing conveyor car being further adapted to move at least at four different elevation levels named from lowest to highest as a lowermost elevation level, base elevation level, first elevation level and second elevation level, and at least a portion of the indexing conveyor car coinciding with one of the roll handling stations is an elevated portion constructed to operate at an elevated level in regard to the other parts of the indexing conveyor car that coincide with the other ones of the roll handling stations.

2. The assembly of claim 1, wherein the elevated portion of the indexing conveyor car coincides with the wrapping station.

3. The assembly of claim 1, further comprising a roll lift for removing the roll from the indexing conveyor car, said roll lift being adapted to operate in the system in conjunction with at least one roll handling station upstream of the wrapping station.

4. The assembly of claim 1, further comprising a roll receiving means for transferring the roll onto the car, said roll receiving means being adapted to operate in the system in conjunction with at least one roll handling station upstream of the wrapping station.

5. The assembly of claim 1, further comprising a centering station for centering a roll and moving the same into an appropriately offset location prior to transferring the roll onto the car.

* * * * *